United States Patent [19]

Carlisle et al.

[11] 4,199,738

[45] Apr. 22, 1980

[54] MULTIPACTOR SWITCH

[75] Inventors: Thomas P. Carlisle, Rolling Hills; Rodney D. Dokken, Hermosa Beach, both of Calif.

[73] Assignee: Hughes Aircraft Company, Culver City, Calif.

[21] Appl. No.: 869,872

[22] Filed: Jan. 16, 1978

[51] Int. Cl.[2] ..... H01P 1/14; H01J 43/02

[52] U.S. Cl. ..... 333/258; 333/203; 333/208; 333/262; 333/99 MP

[58] Field of Search ..... 333/99 MP, 73 W, 13, 333/98 R, 17 L, 98 S, 17 R, 208–212, 202–203, 204–207, 258, 262; 313/104; 315/39.57

[56] References Cited

U.S. PATENT DOCUMENTS

| | | | |
|---|---|---|---|
| 3,278,865 | 10/1966 | Forrer | 333/13 |
| 3,348,169 | 10/1967 | Tomiyasu | 333/13 |
| 3,354,349 | 11/1967 | Horn | 333/13 X |
| 3,967,155 | 6/1976 | Chavanat et al. | 333/99 MP X |

OTHER PUBLICATIONS

Horn, "Application of Multipactor in a T–R Switch", in the Microwave Journal, Nov. 1966, pp. 48–50.

*Primary Examiner*—Alfred E. Smith
*Assistant Examiner*—Marvin Nussbaum
*Attorney, Agent, or Firm*—John Holtrichter, Jr.; W. H. MacAllister

[57] ABSTRACT

The specification describes a vacuum device utilizing the multipacting phenomenon in a special insulated-electrode microwave comb-line structure and functioning as a high speed, single pole, single throw, RF switch with the exception that in the off condition, power is absorbed in the device.

6 Claims, 8 Drawing Figures

MULTIPACTOR SWITCH

BACKGROUND OF THE INVENTION

The background of the invention will be set forth in two parts.

1. Field of the Invention

This invention relates to radio frequency switching devices and more particularly to a high speed microwave switch utilizing the multipacting phenomenon.

2. Description of the Prior Art

Although there has long been a need for fast acting, high power, RF switches, the only known type of switches utilizing multipacting consist of a single coaxial multipactor cavity. These devices are characteristically narrow banded and require mechanical tuning to achieve dynamic range. Comb-line circuits have been used to make broadband (>12%) unbiased multipactor limiters, but not multipactor switches. A prior art multipactor switch of the type above mentioned is described in an article entitled "Duplexing and Switching with Multipactor Discharges" by M. P. Forrer and C. Milazzo, in *Proceedings of the IRE*, April 1962, pp. 442–450.

SUMMARY OF THE INVENTION

In view of the foregoing factors and conditions characteristic of the prior art, it is a primary object of the present invention to provide an improved multipactor switch.

Another object of the present invention is to provide a relatively compact, light weight multipactor switch using a comb-line circuit.

Still another object of the present invention is to provide a high power and relatively broad band RF multipactor switch.

Yet another object of the present invention is to provide a comb-line RF multipactor switch with increased band-width from 2.5% for previous devices to 10% or more, and which allows greater dynamic range without mechanical tuning.

In accordance with an embodiment of the present invention, a multipactor switch capable of switching microwave energy at high switching speeds, includes a waveguide comb-line bandpass filter structure including a plurality of spaced, axially-aligned pairs of opposing electrodes defining predetermined gaps whereat multipactor discharges normally occur. Associated with more than one of the pairs of electrodes are isolation means disposed in the structure for electrically isolating the opposing electrodes. The multipactor switch also includes biasing means coupled to selected ones of the pairs of electrodes having electrically isolated opposing electrodes for providing a predetermined bias potential difference between the isolated opposing electrodes and thereby interrupt normal multipacting action in the gaps between the biased electrode pairs.

The ends of the electrodes defining the gaps are coated with a secondary emission material, and where immediate switching action is desired, an electron gun may be coupled to the periodic structure for insuring that there will be some electrons in the gaps at all times.

Also, oxygen leak and ion pump means may be incorporated for counteracting the reduction action caused by the impinging electrons on the secondary emission material, and for maintaining a vacuum within the structure, respectively.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

DESCRIPTION OF THE PREFERRED EMBODIMENT

Figure 1:
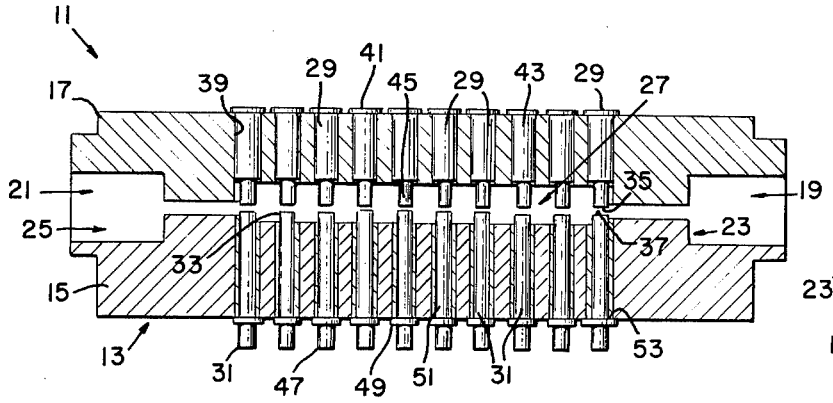
FIG. 1 is a side cross-sectional view in elevation of a multipactor switch constructed in accordance with the present invention.
Figure 2:
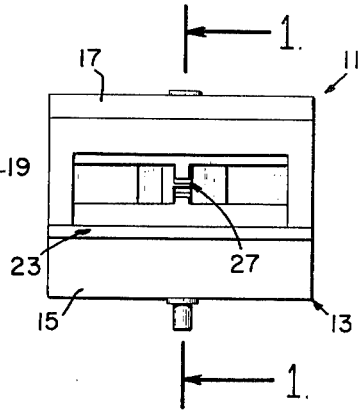
FIG. 2 is an end view of the multipactor switch of FIG. 1.

The invention to be described herein is a multipactor switch which in some ways is similar to multipactor devices that are used in limitors in high-pulse repetition rate radar systems. A multipactor switch differs in that the limiting action can be interrupted at high repetition rates by the application of appropriate voltages.

Referring now to the drawings and more particularly to FIGS. 1–4, there is shown a multipactor switch 11 capable of switching microwave energy at high switching speeds. The switch 11 includes a waveguide comb-line bandpass filter structure 13 which may conveniently be fabricated in two major parts, a main body section 15 and a cover section 17. The structure 13 is provided with an input port 19 and an output port 21, each leading to a conventional step impedance matching and rectangular-to-coaxial (and vice versa), transformation portions 23 and 25, respectively. Disposed between the input and output ports is a narrow gap comb-line section 27 generally comprising a plurality of spaced, axially-aligned pairs of opposing electrodes 29 and 31, which pairs define gaps 33 whereat multipacting discharge normally occurs.

The opposing surfaces 35, 37 of the electrodes are coated or otherwise provided with a secondary emission material (SEM) to enhance the multipactoring discharge. In accordance with this embodiment of the invention, the electrodes 29 depend from the cover section 17 and are electrically connected to the section 17 by any conventional means such as brazing or welding, etc. Thus, each electrode 29 is at the same potential, and may be in the form of a pin extending through a bore 39 in the cover section 17. The pins include a head portion 41, a main body portion 43 and a reduced diameter end portion 45.

Figure 4:
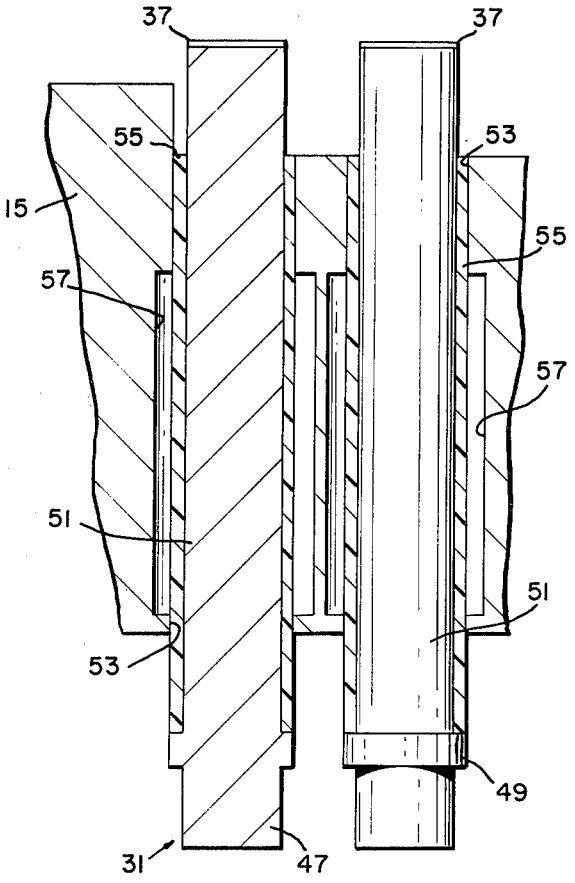
FIG. 4 is an enlarged sectional view of a portion of the comb-line structure of the switch shown in FIG. 1.

The electrodes 31, on the other hand, are (in this embodiment) all electrically insulated from the section 15 of the structure 13, and shown in detail in FIG. 4. Each electrode 31 includes a head portion 47, a flange portion 49 and an elongated portion 51 extending through an associated bore 53 in the main section 15. The elongated portion 51 is fitted into a cylindrical ceramic (or other suitable insulating material) insulating sleeve 55 and is also surrounded by a cylindrical RF choke cavity 57 in order to prevent the coupling of RF energy out of the cavity from other than the output port 21.

Figure 5:
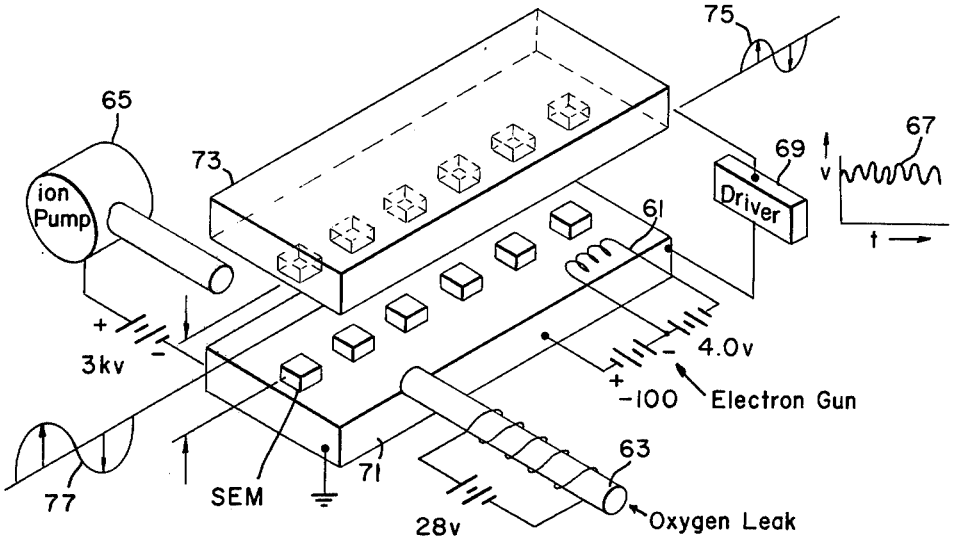
FIG. 5 is a schematic drawing of a multipactor switch constructed in accordance with an embodiment of the present invention.

FIG. 5 shows schematically an embodiment of the invention incorporating an electron gun 61, an oxygen leak 63 and an ion pump circuit 65. For the sake of simplicity, this diagram signal shows a bias signal 67 provided by a driver 69 coupled to blocks 71 and 73, each carrying one side of the opposing electrodes which define the caps between which the multipacting action normally occurs. As seen in this figure, when the multipacting action is interrupted by the application of the bias signal 67, as will be described in detail later, the output signal 75 is significantly reduced in comparison to the input signal 77.

To best describe the operation of the invention, it is advantageous to first describe the operation of the multipactor limiter aspects of the switch. A multipactor limitor employs the multipacting phenomena, as the name implies. Incident RF power enters the periodic structure 13 which consists of a rigid wave guide circuit with symmetrical input and output impedance matching sections 23, 25 and the narrow gap comb-line filter 27 disposed therebetween. The incident RF wave establishes a sinusoidal voltage in the gaps 33 between the axially-aligned opposing electrodes 29, 31. As seen in FIG. 5, a small non-critical electron gun 61 can be used to insure that there are some electrons in the gaps 33 at all times. The electric field generated by the incoming RF wave forces the electrons to traverse the gaps and hit the coated surfaces. When each of these electrons collide with the secondary emission material (SEM), they release ten to fifteen secondary electrons. As the electric field changes direction during the next half cycle, the reverse electric field accelerates the electrons back across the gaps. If the transit time of the electrons across the gaps is one-half cycle of the RF field, the secondary electrons formed by the initial electrons become primary electrons for the next half cycle to form another group of secondary electrons. In this way, large electron densities rapidly build up in each gap. The number of electrons increase until space charge forces oppose the accelerating force of the RF electric field. Thus, new secondary electrons see a large space charge field which prevents them from joining the multipacting electron cloud. The final state of equilibrium exists when only one secondary electron joins the cloud for every impinging electron on the secondary surface.

The electron cloud moves in phase with the applied electric field; consequently, it absorbs energy from the RF field. A large fraction of the incoming RF power is dissipated at each gap in the form of heat at the gap surfaces.

To counteract the reducing action caused by the impinging electrons on the secondary emission material, a simple conventional oxygen leak device 63 is included in the structure. In addition, a small integral ion pump 65 is used to maintain a good vacuum. Of course, conventional gas-tight windows are provided at the input and output ports in this connection.

Figure 3:
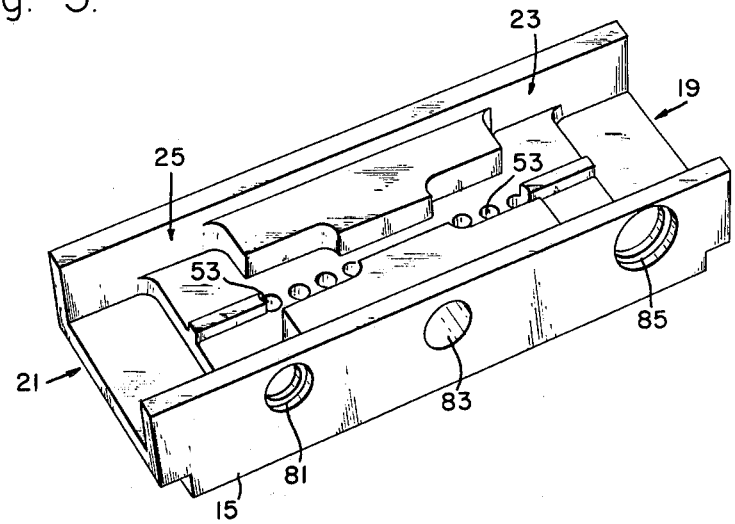
FIG. 3 is a perspective view of the main body section of the device of FIG. 1.

Extending the teachings of the prior art, the present invention utilizes the fact that the multipacting phenomenon can occur only if the RF voltage in a gap is such that an electron crosses the gap in a half RF cycle. It is thus possible to interrupt the multipacting action with an applied bias voltage. This requires that the halves of the comb-line filter be electrically isolated. One isolated, as shown in FIGS. 1–4, the device can be used to modulate an RF signal. With the bias signal applied to the electrode pairs, the multipacting action is interrupted and the applied RF energy is not attenuated. However, when the bias signal is removed, the multipacting starts and the device exhibits high isolation. Viewed in this manner, the device can be used as an on-off RF switch, with the exception that in the off condition a large fraction of the RF energy is absorbed in the device. The apertures 81, 82 and 83 in the main body section 15 of FIG. 3 are adapted to respectively accommodate a conventonal ion pump, an oxygen leak and an electron gun.

Figure 6:
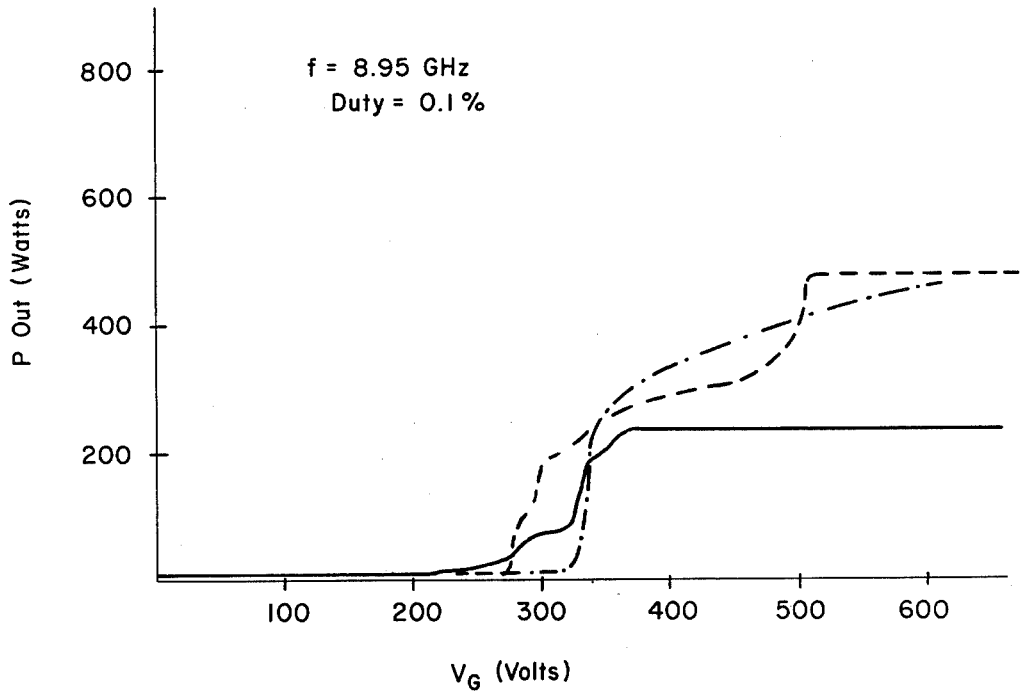
FIG. 6 is a graph comparing applied bias voltage to peak output power.

The embodiment of the multipactor switch 11 shown in FIG. 1 has been designed so that a separate modulating voltage could be applied to each of its ten multipacting gaps. The data presented in FIGS. 6–8 has been taken with the first three electrodes 31 connected to a variable bias supply, the center four electrodes 31 connected to ground, and the remaining three electrodes biased at 650 Vdc.

The characteristic which best describes the performance of the device is the applied bias voltage to peak output power transfer function. This type of data is shown as a family of curves in FIG. 6. From these curves it can be seen that the device can best be operated as a switch by applying a DC bias just below the switching threshold and then pulsing up to a voltage which allows the maximum power to pass through the device. For example, at an input power of 1500 watts peak, a DC bias of 320 volts with a 300 volt peak-to-peak pulse superimposed would switch the RF power from 8.0 watts to 750 watts.

Figure 8:
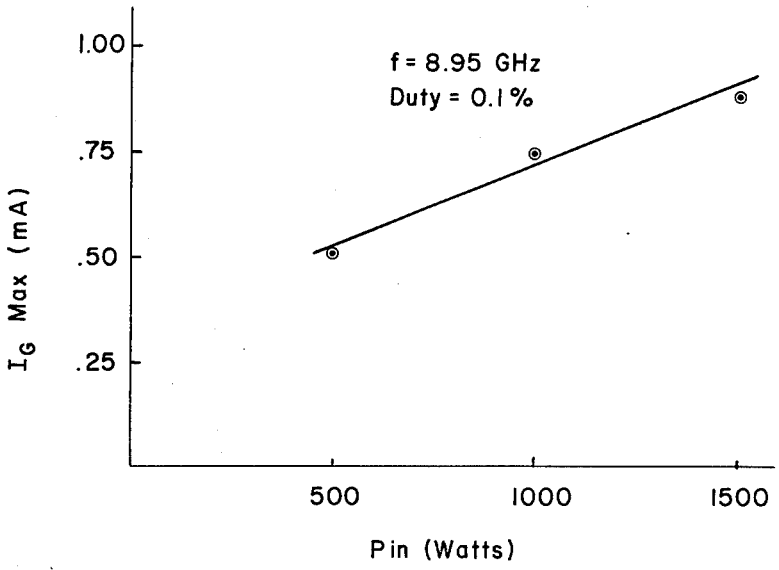
FIG. 8 is a graphical presentation showing the relationship between the maximum average gap current and the input power of the invention.
Figure 7:
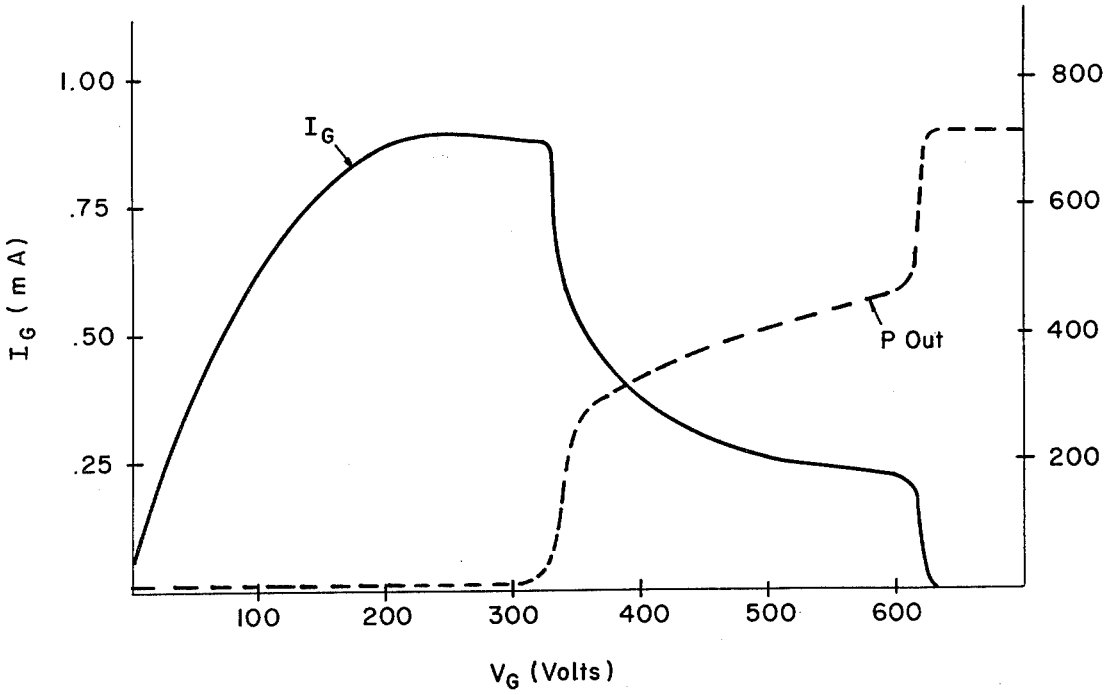
FIG. 7 is a gap current vs gap voltage graph.

In the embodiment described, the load presented to the modulator by the device 11 is both reactive and resistive. The reactive component consists of the capacitance of the first three gaps, and are generated primarily by the RF chokes 57. The reactive component is illustrated in FIG. 7, where the total average gap current of the first three gaps is ploted versus the gap voltage. A plot of maximum average gap current versus input power is shown in FIG. 8.

Although specific embodiments of the invention have been described, it should be understood that other embodiments incorporating the teachings of the invention are considered within the scope and contemplation of the invention. For example, the electrodes on either side, or both sides, of the gaps may be isolated.

What is claimed is:

1. A multipactor switch capable of switching microwave energy at high switching speeds, comprising:

a waveguide comb-line bandpass filter structure including a plurality of spaced, axially-aligned pairs of opposing electrodes defining predetermined gaps whereat multipacting discharges normally occur;

isolation means disposed in said structure and associated with more than one of said pairs of electrodes for electrically isolating said opposing electrodes; and biasing means coupled to selected ones of said pairs of electrodes having electrically isolated opposing electrodes for providing a predetermined bias potential difference between said isolated opposing electrodes and thereby interrupt normal multipacting action in the gaps between the biased electrode pairs.

2. The multipactor switch according to claim 1, wherein said isolation means includes insulation material disposed about at least a portion of the elongate cylindrical surface of selected ones of said electrodes.

3. The multipactor switch according to claim 1, wherein said isolation means includes an RF choke cavity structure disposed about at least a portion of the elongate cylindrical surface of selected ones of the electrodes.

4. The multipactor switch according to claim 1, also comprising vacuum means for maintaining the region of said gaps in at least a partial vacuum.

5. The multipactor switch according to claim 1, also comprising electron means for maintaining a supply of electrons in the region of said gaps.

6. The multipactor switch according to claim 1, wherein a secondary emission material is disposed the ends of said electrodes defining said gaps.

* * * * *